United States Patent [19]

Benz

[11] Patent Number: 4,537,008

[45] Date of Patent: Aug. 27, 1985

[54] METHOD AND APPARATUS FOR PACKING SOFT PACKAGES INTO BOXES

[75] Inventor: Gotlieb Benz, Flums, Switzerland

[73] Assignee: Machinenfabrik Flums AG, Flums, Switzerland

[21] Appl. No.: 556,794

[22] Filed: Dec. 1, 1983

[30] Foreign Application Priority Data

Dec. 8, 1982 [CH] Switzerland ..... 7133/82

[51] Int. Cl.[3] ..... B65B 63/02; B65B 35/40; B65B 35/50

[52] U.S. Cl. ..... 53/438; 53/245; 53/250; 53/447; 53/473; 53/529; 53/535; 53/540

[58] Field of Search ..... 53/243, 245, 249, 250, 53/255, 438, 443, 447, 473, 475, 529, 535, 536, 537, 540

[56] References Cited

U.S. PATENT DOCUMENTS 3,745,740 7/1973 Williams ..... 53/535

*Primary Examiner*—Robert L. Spruill
*Assistant Examiner*—Michael D. Folkerts
*Attorney, Agent, or Firm*—Willian Brinks Olds Hofer Gilson & Lione Ltd.

[57] ABSTRACT

The present invention is directed to a method and apparatus for packing tubular bags into boxes by machinery. The tubular bags to be packed are conveyed over various conveyor belts to a positioning belt and from the positioning belt to a positioning table. Layers of tubular bags are then moved onto a rake-like main base that is lowered in a stepwise fashion to receive consecutive layers of tubular bags. When the desired number of tubular bag layers is positioned on the main base, the main base is lowered to deposit the tubular bags onto an intermediate base which together with side walls makes up an intermediate container. Once the intermediate container is in a lower position, a box is pushed over the intermediate container and the intermediate container is swung through a 90° arc onto a conveyor belt. The intermediate container is then removed from the box and by this process the tubular bags which were previously in the intermediate container are transferred into the box. The intermediate container then swings back to its lower position.

10 Claims, 5 Drawing Figures

Fig. 1
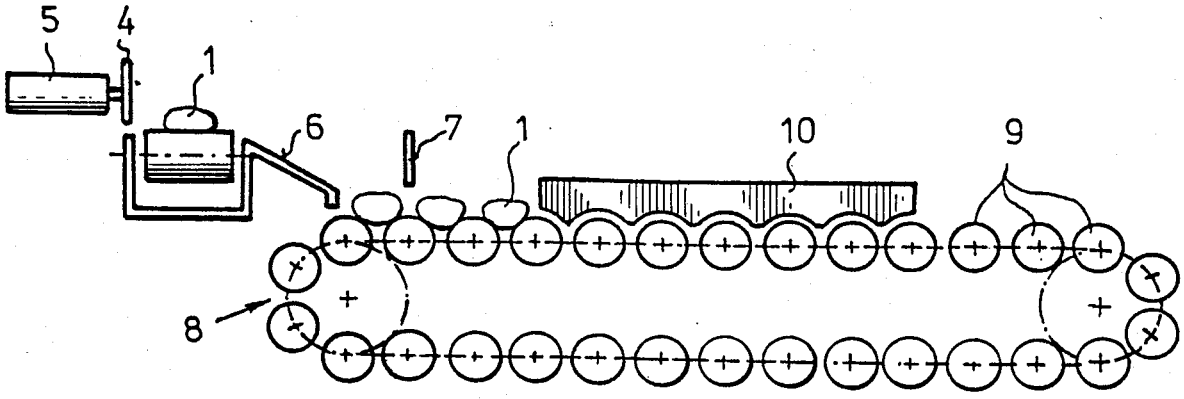
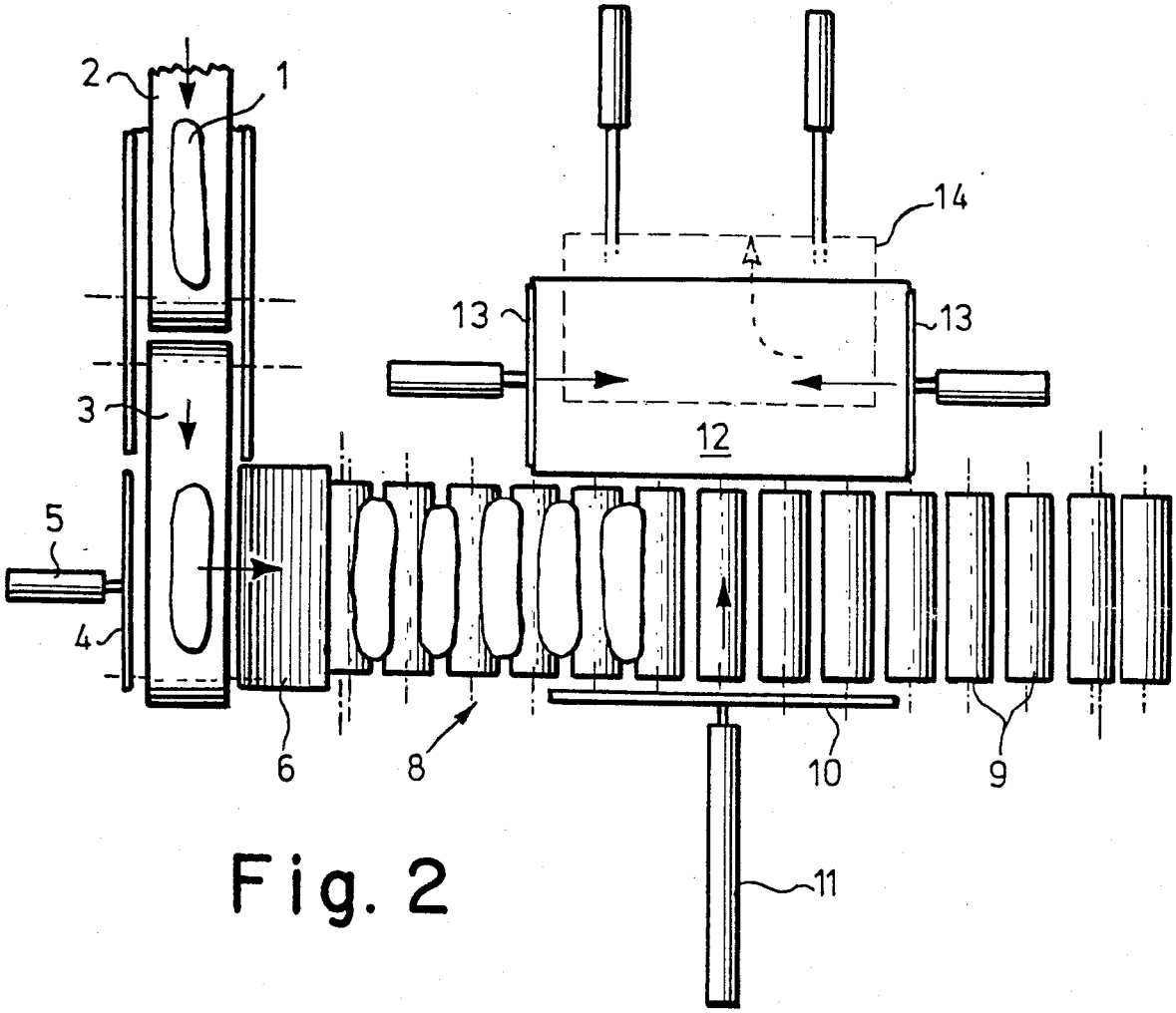
Fig. 2

METHOD AND APPARATUS FOR PACKING SOFT PACKAGES INTO BOXES

BACKGROUND OF THE INVENTION

The present invention relates to a process for packing tubular bags into boxes, as well as to an apparatus for executing the process of this invention.

Tubular bags are a form of packaging made from a tube such as an endless welded tube. Typically, in a first stage the tube is closed at one end; in a second stage the tube is filled with the material to be packed; and finally in a third stage the tube is sealed and severed from the remaining portion of the tube. Such packaging is typically used in the packing of liquid and paste-like substances.

In view of the fact that such a tubular bag is typically not rigid and that its contents are typically plastic or liquid, the packaging unit is not stable in shape. It is for that reason extremely difficult to manage in machine handling. It is not surprising, therefore, that filled tubular bags were packed only by hand in a wide variety of applications of the prior art.

SUMMARY OF THE INVENTION

The present invention is directed to a method and apparatus for the machine packing of such tubular bags into boxes.

According to this invention a method of packing a plurality of tubular bags into boxes is provided in which the tubular bags are conveyed in layers between two fixed lateral walls and a depth bounding wall and are supported by a rake-like main base which is lowerable in a step-wise fashion. When a desired number of layers of tubular bags has been reached, the main base is lowered in order to deposit the layers of tubular bags on a similar rake-like intermediate base. This rake-like intermediate base includes side walls and forms an intermediate container which, when in an upper starting position, is positioned outside of the stationary lateral walls. When the intermediate base and container are lowered to an end position and after the main base has been moved to a lower position than the intermediate base, a box is positioned over the intermediate container and the tubular bags contained within it. Then the tubular bags are moved from the intermediate container into the box and the box (including the packed tubular bags) is removed.

As described in detail below, an apparatus for executing the above-described process may include two columns and means for elevationally moving the two rake-type bases described above. In this form of the invention, both the main and intermediate base are mounted for vertical movement between the two columns. The fixed lateral walls and the depth bounding wall are fixed in place between the upper portions of the two columns and cooperate with the elevationally adjustable main base to form a first container. This first container is partially surrounded by the intermediate container formed by the intermediate base and the two side walls fastened to it. As explained above, the two side walls of the intermediate container are separated by a distance somewhat greater than the separation between the two fixed lateral walls. Thus, when the main base is lowered below the level of the intermediate base, the contents of the first container are deposited into the intermediate container. It is this intermediate container over which the box is slidable.

The apparatus and method of this invention provide important advantages in allowing reliable and automatic packaging of tubular bags into boxes. These advantages are accomplished in spite of the deformable nature of the tubular bags and the difficulty with which they are handled by machines.

The invention itself, together with further objects and attendant advantages, will best be understood by reference to the following detailed description, taken in conjunction with the accompanying drawings.

BRIEF DESCRIPTION OF THE DRAWINGS

FIG. 1 is a vertical sectional view of a portion of a presently preferred embodiment of the apparatus of this invention for feeding tubular bags to be packed.

FIG. 2 is a plan view of the feed unit of FIG. 1 in which further features of this embodiment are shown.

DETAILED DESCRIPTION OF THE PRESENTLY PREFERRED EMBODIMENT

Figure 4:
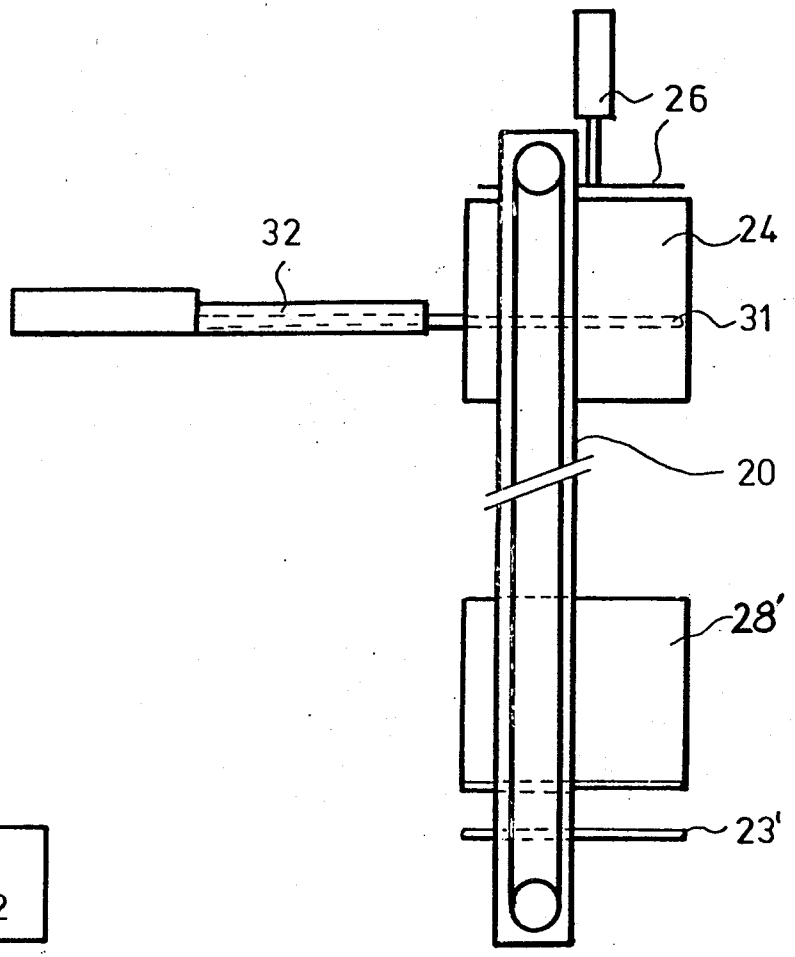
FIG. 4 is a side sectional view of the collecting unit and vertical transport unit of FIG. 3.

Turning now to the drawings, all of the figures show simplified, schematic representations of the presently preferred embodiment of the apparatus of this invention. In these drawings, details well known to those skilled in the art have been omitted in the interest of clarity. In addition, in order to simplify the drawings and improve their clarity, each of the drawings represents only portions of the total apparatus.

In the following description there are repeated references to pneumatic cylinder and piston units. Of course, it should be understood that hydraulic or equivalent electromechanical actuators may be used in alternate embodiments of this invention.

Turning now to FIGS. 1 and 2, tubular bags 1 to be packed are conveyed upwardly to a higher level by means of a conveyor belt 2 which is arranged in the manner of a ramp as shown in FIG. 2. The tubular bags 1 pass from the conveyor belt 2 to a horizontal conveyor belt 3. Optical sensors (not shown) are provided on the horizontal conveyor belt 3 in order to establish when a tubular bag 1 is positioned in front of a thrust plate 4. When a tubular bag 1 is properly positioned in front of the thrust plate 4, the conveyor belt 3 is stopped and a slightly time-shifted signal is then generated to activate a pneumatic cylinder and piston unit 5. This unit 5 operates to move the plate 4 in a direction parallel to the plane of the conveyor belt 3 and transversely to its direction of forward movement. The tubular bag 1 positioned in front of the plate 4 is thereby pushed from the conveyor belt 3. Such tubular bags then slide by means of a ramp 6 onto a positioning belt 8 situated beneath the ramp 6. A stop plate 7 is provided to prevent the tubular bags 1 from orienting themselves obliquely on the positioning belt 8 or sliding too far forwardly away from the ramp 6. The positioning belt 8 is profiled suitably to ensure exact positioning of the tubular bags 1 on the belt 8.

Figure 3:
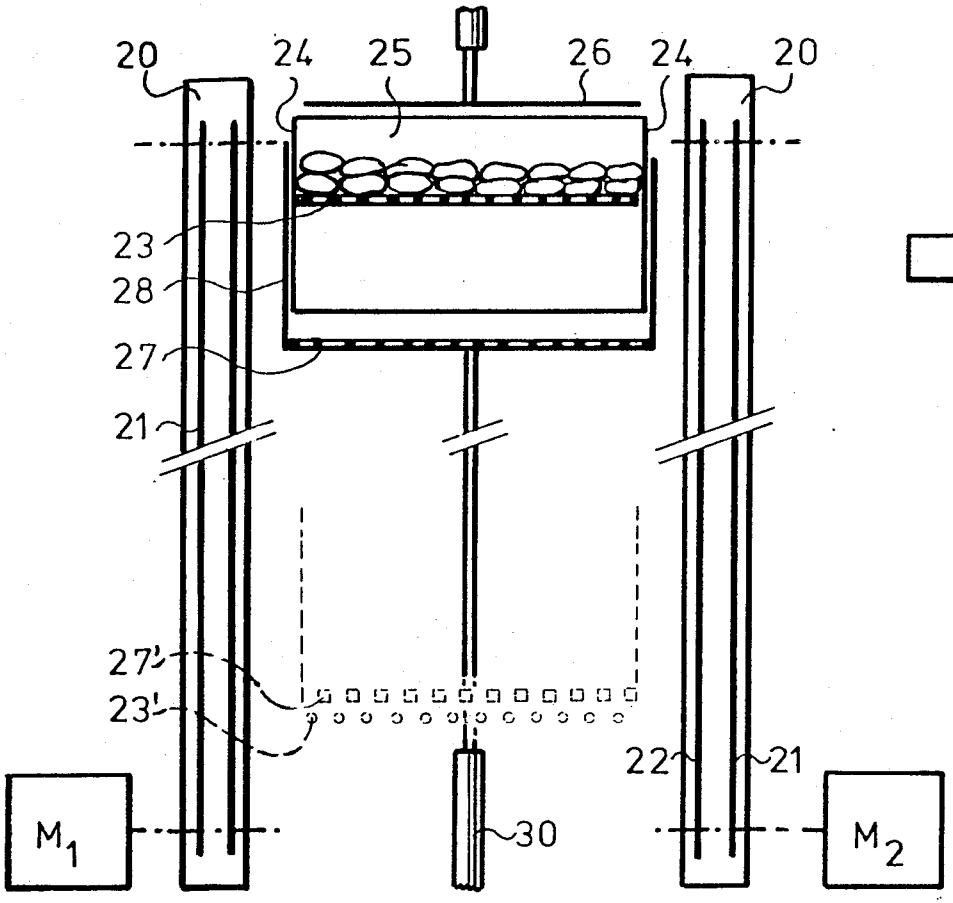
FIG. 3 is a vertical sectional view of the collecting unit and vertical transport unit of the embodiment of FIG. 1.

As best shown in FIG. 1, in this preferred embodiment the positioning belt 8 is formed of a chain of synthetic material rollers 9, the length of which corresponds at least to the length of the tubular bags 1 to be packed. The depression between two adjacently situated rollers 9 in each case defines the position of a tubular bag 1 exactly. As soon as one tubular bag 1 has fallen onto the positioning belt 8, the belt 8 is moved forwardly by the distance between the axes of two adjacent rollers 9. Near the middle of the upper portion of the belt 8 there is arranged a comb-like rake 10 mounted for movement parallel to the plane of the belt 8 and perpendicular to the direction of forward movement of the belt 8. The toothed form of the rake 10 corresponds to the profile of the positioning belt 8. When the foremost tubular bag 1 in the direction of movement of the positioning belt 8 is in front of the last tooth of the rake 10 (which can for example be electro-optically detected) the belt 8 is stopped. A pneumatic piston and cylinder unit 11 is then used to move the rake 10 transversely to the direction of forward movement of the positioning belt 8. All of the tubular bags 1 lying in front of the rake 10 are thereby pushed from the positioning belt 8 onto a positioning table 12. This positioning table 12 is oriented at about the level on which the tubular bags 1 lie on the positioning belt 8, or slightly lower. Two pneumatically operable pushers 13 are situated on both sides of the positioning table 12. After the rake 10 has traveled back into its starting position, these pushers 13 push together the tubular bags lying on the positioning table 12, and the pushers 13 remain in this position until a swinging plate 14 has pushed the compressed tubular bags 1 from the positioning table 12. The swinging plate 14 is mounted over the positioning table 12 for this purpose. The swinging plate 14 pushes the tubular bags 1 from the table 12 to a region between two lateral walls 24 which are mounted in a fixed position between two columns 20 as shown in FIG. 3. The pushers 13 operate to compress the tubular bags 1 such that they are situated more closely together than the distance between the fixed side walls 24. After a layer of compressed tubular bags 1 has been moved into the region between the fixed side walls 24, both the pushers 13 and the swinging plate 14 return to their starting positions.

Turning now to FIGS. 3 and 4, after the tubular bags have been delivered from the positioning table 12 onto a main base 23, the tubular bags are in the collecting and vertical transport unit shown in FIGS. 3 and 4. The whole unit is shown in somewhat shortened form in height in these drawings for reasons of economy of space. The unit includes two vertical columns 20, each of which serves to mount two closed chain drives 21,22 which are used as described below to provide elevational adjustment. The outer pair of chains 21 is driven, for example, by an electrical motor $M_1$, and the inner pair of chains 22 is driven by a second electric motor $M_2$. One pair of chains, for example the inner pair of chains 22, serves to control and adjust the elevation or height of the main base 23 previously mentioned. The main base 23, which is movable up and down between the two columns 20, is initially approximately at the level of the positioning table 12. After the first layer of tubular bags 1 has been pushed from the positioning table 12 onto the main base 23, the main base 23 is lowered by the motor $M_2$ by means of its chain drive 22 by the height of one layer of tubular bags. The exact position of the tubular bags on the main base 23 is defined laterally by means of two fixed lateral walls 24 which are fixedly mounted with respect to the columns 20. The slide-in depth of the tubular bags 1 on the main base 23 is determined by a rear wall 25. This rear wall 25 is made up of an array of flat bars which lie in a plane and are separated by intervening spaces. The main base 23 is made up of a rake-like array of round bars which together form a grating. The main base 23 is mounted to slide between the fixed lateral walls 24 up and down as described above. When the main base 23 is positioned between lateral walls 24, the round bars of the main base 23 move in the spaces between the flat bars which define the rear wall 25.

As soon as a layer of tubular bags 1 is deposited on the main base 23, a pneumatically driven stamp 26, which corresponds in its dimensions to approximately the size of the main base 23, descends and presses against the tubular bags 1. The main base 23 is then lowered by the height of one layer of tubular bags. This cycle is repeated until the desired number of layers of tubular bags 1 is present on the main base 23. As soon as this number is reached, the motor $M_2$ is again driven and the main base 23 descends further. The main base 23 in cooperation with the fixed lateral walls 24 and the fixed rear wall 25 together form a first container. Initially, this first container is surrounded by an intermediate container which consists of a rake-like grate which forms an intermediate base 27, two side walls 28, and a rear wall 25 again formed of flat bars. The bars of the grate which makes up the intermediate base 27 are staggered with respect to the bars of the main base 23. As the main base 23 is lowered past the intermediate base 27, the bars of the main base 23 slide between the bars of the intermediate base 27. When this happens, the stacked tubular bags 1 on the main base 23 are deposited on the intermediate base 27 of the intermediate container. The intermediate base 27 is adjustable in elevation by means of a pneumatic piston and cylinder unit 30. In order that the apparatus can operate sufficiently quickly without lowering the main base 23 too abruptly with respect to the intermediate base 27, the main base 23 and the intermediate base 27 are lowered simultaneously, but with the main base 23 moving at a higher speed. Thus, the intermediate base 27 slides to a lower position indicated by reference numeral 27' in FIG. 3, while the main base 23 moves more quickly into a lower position 23' which is beneath the lower position 27' of the intermediate base. While the main base 23 is in the lower position 23', an auxiliary base 31 takes over its function. The auxiliary base 31 is shifted from a horizontal, retracted position hydraulically forward in a slidepiece 32 into the region between the fixed lateral walls 24. The entire slidepiece 32 and the auxiliary base 31 are suspended on the outer chains 21 and are movable in height by means of the motor $M_1$. The auxiliary base 31 functions in a manner which corresponds entirely to that of the main base 23 as described above up to the point in time at which the main base 23 again is moved upwardly in order to support the stacked tubular bags 1 located between the lateral walls 24. Once the main base 23 is again raised to support the stacked tubular bags in the first container, the auxiliary base 31 can be retracted to its starting position. The auxiliary base 31 thereby assures continuous operation.

Figure 5:
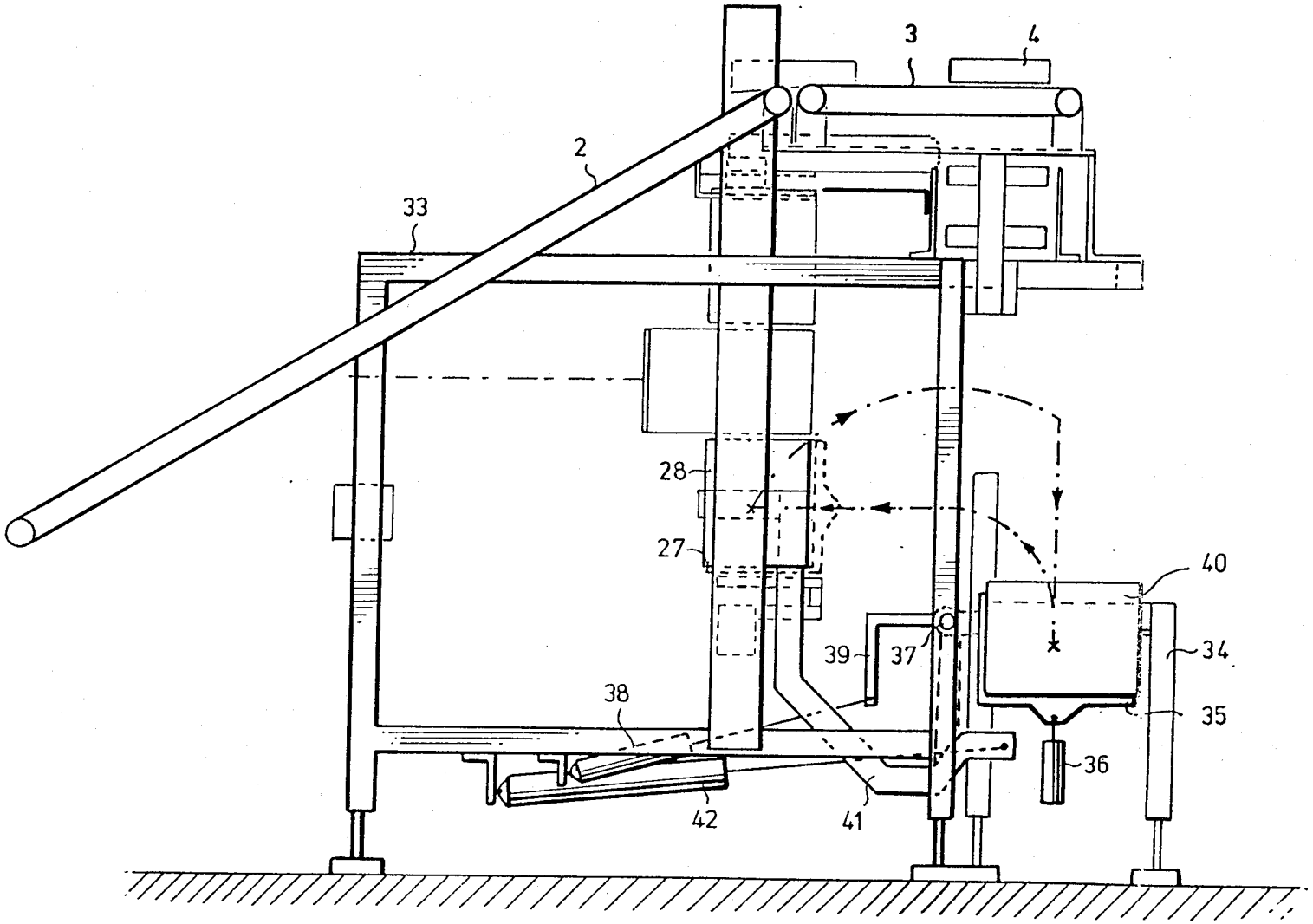
FIG. 5 is a schematic side elevational view of the embodiment of FIG. 1.

The last step of the packing process of this embodiment will be described in conjunction with FIG. 5 which illustrates the transfer unit. Briefly stated, FIG. 5 shows the tubular bag conveying means 2,3,4 discussed above, as well as the vertical transport unit carried by the columns 20. In FIG. 5 the intermediate container 27,28 is shown in its lower position. The machine frame is designated as a whole with the reference numeral 33. In FIG. 5 a feed unit 34 for boxes 40 is shown only in part. As shown in FIG. 5, a box 40 is positioned on a platform 35. The platform 35, together with the piston and cylinder unit 36, is mounted to pivot about an axis 37 mounted in the frame 33. The swinging movement of the platform 35 is controlled by means of a pneumatic piston and cylinder unit 38 which is mounted between the frame 33 and a lever arm 39 secured to the platform 5. The unit 38 can be used to pivot the platform 35 from the start position shown in FIG. 5 by about 90° around the axis 37 in a counterclockwise direction. The box 40 is initially placed on the platform 35 with an open side directed upwardly. After it is rotated by 90° along the lower of the two dot-dash lines of FIG. 5, this open side of the box 40 is oriented toward the intermediate container 27,28. Preferably, the lower edge of the box 40 is positioned slightly lower than the level of the intermediate base 27. Once the platform 35 has been rotated by 90°, the pneumatic unit 36 is actuated to slide the box 40 over the intermediate container 27,28.

The pneumatic piston and cylinder unit 30 which controls the vertical position of the intermediate container 27,28 is mounted between two fork-shaped arms 41 which are joined together. The two arms 41 are rotatably mounted about an axis 37 with respect to the frame 33. A pneumatic piston and cylinder unit 42 is mounted between the arms 41 and the frame 33 in order to rotate the arms 41 about the axis 37. After the box 40 has been pushed over the intermediate container 27,28, the piston and cylinder unit 42 is operated and the arms 41 begin a rotary movement through 90°, in a clockwise direction as seen in FIG. 5. As the arms 41 swing, the intermediate container 27,28 with its load of stacked tubular bags contained in the box 40 moves along the upper dotted line of FIG. 5. During this swinging movement the force of gravity acting on the platform 35 increases as the stacked tubular bags slide more and more from the intermediate container 27,28 into the box 40. During this period no pressure is applied to the piston and cylinder unit 36, and the platform 35 thereby returns to its lowered starting position as the platform 35 is moved back toward its starting position by the arms 41. Finally, the box 40 descends to its starting position back onto the conveyance portion of the feed unit 34.

As soon as the intermediate container 27,28 has been moved out of the zone between the columns 20, the main base 23 is again moved upwardly in order to resume the support of the tubular bags already stacked on the auxiliary base 31. Once this is accomplished, the auxiliary base 31 is retracted into the slidepiece 32 and lifted into its starting position.

Finally, after the contents of the intermediate container 27,28 have been emptied into the box 40, the empty intermediate container 27,28 is swung back into position between the columns 20 and lifted again to its upper position. At this point, the entire cycle can begin again.

In the event that a continuous operation is not required, the embodiment described above can operate properly without the auxiliary base 31.

From the foregoing, it should be apparent that an automatic stacking method and apparatus have been described for stacking tubular bags into boxes. The method and apparatus of this invention operate reliably and automatically, even with the notoriously difficult to handle tubular bags.

Of course, it should be understood that a wide range of changes and modifications to the preferred embodiment described above will be apparent to those skilled in the art. It is therefore intended that the foregoing detailed description be regarded as illustrative rather than limiting, and that it be understood that it is the following claims, including all equivalents, which are intended to define the scope of this invention.

I claim:

1. A method of packing a plurality of tubular bags in a box comprising the following steps:

(a) placing the tubular bags in layers between two lateral walls and one depth bounding wall and supported by a stepwise lowerable, rake-like main base;

(b) lowering the main base after a desired number of layers of tubular bags has been deposited thereon in order to deposit the tubular bags in an intermediate container which comprises an intermediate rake-like base, and a pair of side walls disposed outside of the lateral walls when the intermediate container is situated in an upper position;

(c) lowering the intermediate container to a lower position and the main base to a position below the intermediate base;

(d) moving a box over the intermediate container; and (e) depositing the tubular bags from the intermediate container into the box.

2. The method of claim 1 wherein steps (d) and (e) comprise the following steps:

orienting the box in a starting position with an open side oriented upwardly;

rotating the box through 90° to position the box with the open side adjacent to and slightly lower than the intermediate container;

moving the box to surround the intermediate container; and swinging the box with the intermediate container back to the starting position.

3. The method of claim 1 further comprising the step of:

moving an auxiliary rake-like base, horizontally into position between the lateral walls after the intermediate container has been lowered in step (c);

lowering the auxiliary base in a stepwise fashion as layers of the tubular bags are added; and returning the auxiliary base to a storage position after the main base has been raised to support the layers of the tubular bags.

4. The method of claim 1 wherein step (a) comprises the following steps:

moving the bags from a conveyor belt to a stepwise movable positioning belt;

moving a layer of the bags from the positioning belt to a positioning table;

pushing the bags on the table laterally together; and pushing the bags from the table to the region between the lateral walls.

5. The method of claim 1 wherein step (a) comprises the step of:

compressing each of the layers of the bags by means of a stamp against one of the bases supporting the layers.

6. An apparatus for packing a plurality of tubular bags in boxes, said apparatus comprising:

two spaced columns;

a rake-like main base;

an intermediate container comprising a rake-like intermediate base and two side walls;

means for moving the main base vertically between the columns;

means for moving the intermediate container vertically between the columns;

two lateral walls and a back wall fixedly mounted with respect to the columns to form a first container in cooperation with the main base when the main base is in an upper position, said two lateral walls separated by a distance less than the separation of the two side walls such that the first container is sized to fit partially within the intermediate container;

means for placing the tubular bags in layers in the first container and supported by the main base as the main base is lowered in a stepwise fashion;

said main base movable vertically from a position above the intermediate base to a position below the intermediate base such that the layers of bags in the first container are transferred to the intermediate container as the main base is moved below the intermediate base;

means for moving a box over the intermediate container when the intermediate container is in a lower position; and means for transferring the bags from the intermediate container to the box.

7. The invention of claim 6 wherein the means for moving the box comprises:

a box supply line;

a box supporting platform mounted adjacent to the supply line for rotation about an axis;

means for rotating the platform by 90° from a start position, in which an open side of the box is oriented upwardly, to a load position, in which the open side of the box is positioned adjacent to the intermediate container;

means for pushing the box over the intermediate container when the platform is in the load position; and wherein the transferring means comprises:

a pair of arms which support the intermediate container and are rotatable about an axis oriented parallel to a plane passing between the columns and near the supply line; and means for rotating the arms to tip the intermediate container and return the platform to the start position.

8. The invention of claim 6 further comprising:

a rake-like auxiliary base;

means for mounting the auxiliary base for horizontal sliding movement into position between the lateral walls after the intermediate container has been lowered;

means for lowering the auxiliary base in a stepwise fashion as layers of the tubular bags are added; and means for returning the auxiliary base to a storage position after the main base has been raised to support the layers of the tubular bags.

9. The invention of claim 6 wherein the means for placing the tubular bags in layers further comprises:

conveyor means for transporting the bags;

a stepwise movable positioning belt;

means for pushing the bags from the conveyor means to the positioning belt;

a positioning table oriented substantially in the plane of the positioning belt;

a comb-like rake;

means for moving the rake to push a layer of the bags from the positioning belt to the table;

means for pushing the bags on the table laterally together; and a swingable plate mounted over the table to push the bags from the table to the region between the lateral walls over the uppermost one of the bases.

10. The invention of claim 6 further comprising:

a vertically movable stamp positioned between the columns above the uppermost position of the bases; and means for moving the stamp downwardly to compress a layer of bags against the one of the bases supporting the layer.

* * * * *